US007851519B2

(12) United States Patent
Agur et al.

(10) Patent No.: US 7,851,519 B2
(45) Date of Patent: Dec. 14, 2010

(54) POLYESTER EMULSION CONTAINING CROSSLINKED POLYESTER RESIN, PROCESS, AND TONER

(75) Inventors: Enno E. Agur, Toronto (CA); Daryl W. Vanbesien, Burlington (CA); Valerie M. Farrugia, Oakville (CA); Guerino G. Sacripante, Oakville (CA); Maria N. V. McDougall, Oakville (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 778 days.

(21) Appl. No.: 11/626,977

(22) Filed: Jan. 25, 2007

(65) Prior Publication Data

US 2008/0182193 A1 Jul. 31, 2008

(51) Int. Cl.

| | |
|---|---|
| ***C08J 3/07*** | (2006.01) |
| ***C08J 3/09*** | (2006.01) |
| ***C08J 3/24*** | (2006.01) |
| ***C08F 8/00*** | (2006.01) |

(52) U.S. Cl. ..... 523/340; 523/501; 525/377; 525/387

(58) Field of Classification Search ..... 523/340, 523/501; 525/387, 377

See application file for complete search history.

(56) References Cited

U.S. PATENT DOCUMENTS

| | | | | | |
|---|---|---|---|---|---|
| 2,957,843 | A | * | 10/1960 | Anderson et al. | 524/377 |
| 3,692,724 | A | * | 9/1972 | Van Dyk | 523/502 |
| 3,847,604 | A | | 11/1974 | Hagenbach et al. | |
| 4,240,947 | A | * | 12/1980 | Falk | 524/604 |
| 4,252,704 | A | * | 2/1981 | Falk | 524/457 |
| 4,338,390 | A | | 7/1982 | Lu | |
| 4,523,008 | A | * | 6/1985 | Vogl et al. | 528/288 |
| 4,551,390 | A | * | 11/1985 | Canning et al. | 428/431 |
| 4,935,326 | A | | 6/1990 | Creatura et al. | |
| 4,937,166 | A | | 6/1990 | Creatura et al. | |
| 5,278,020 | A | | 1/1994 | Grushkin et al. | |
| 5,290,654 | A | | 3/1994 | Sacripante et al. | |
| 5,308,734 | A | | 5/1994 | Sacripante et al. | |
| 5,344,738 | A | | 9/1994 | Kmiecik-Lawrynowicz et al. | |
| 5,346,797 | A | | 9/1994 | Kmiecik-Lawrynowicz et al. | |
| 5,348,832 | A | | 9/1994 | Sacripante et al. | |
| 5,364,729 | A | | 11/1994 | Kmiecik-Lawrynowicz et al. | |
| 5,366,841 | A | | 11/1994 | Patel et al. | |
| 5,370,963 | A | | 12/1994 | Patel et al. | |
| 5,403,693 | A | | 4/1995 | Patel et al. | |
| 5,405,728 | A | | 4/1995 | Hopper et al. | |
| 5,418,108 | A | | 5/1995 | Kmiecik-Lawrynowicz et al. | |
| 5,496,676 | A | | 3/1996 | Croucher et al. | |
| 5,501,935 | A | | 3/1996 | Patel et al. | |
| 5,527,658 | A | | 6/1996 | Hopper et al. | |
| 5,585,215 | A | | 12/1996 | Ong et al. | |
| 5,650,255 | A | | 7/1997 | Ng et al. | |
| 5,650,256 | A | | 7/1997 | Veregin et al. | |
| 5,656,408 | A | * | 8/1997 | Silence | 430/111.35 |
| 5,723,253 | A | | 3/1998 | Higashino et al. | |
| 5,744,520 | A | | 4/1998 | Kmiecik-Lawrynowicz et al. | |
| 5,747,215 | A | | 5/1998 | Ong et al. | |
| 5,763,133 | A | | 6/1998 | Ong et al. | |
| 5,766,818 | A | | 6/1998 | Smith et al. | |
| 5,804,349 | A | | 9/1998 | Ong et al. | |
| 5,827,633 | A | | 10/1998 | Ong et al. | |
| 5,840,462 | A | | 11/1998 | Foucher et al. | |
| 5,853,944 | A | | 12/1998 | Foucher et al. | |
| 5,863,698 | A | | 1/1999 | Patel et al. | |
| 5,869,215 | A | | 2/1999 | Ong et al. | |
| 5,902,710 | A | | 5/1999 | Ong et al. | |
| 5,910,387 | A | | 6/1999 | Mychajlowskij et al. | |
| 5,916,725 | A | | 6/1999 | Patel et al. | |
| 5,919,595 | A | | 7/1999 | Mychajlowskij et al. | |
| 5,925,488 | A | | 7/1999 | Patel et al. | |
| 5,977,210 | A | | 11/1999 | Patel et al. | |
| 5,994,020 | A | | 11/1999 | Patel et al. | |
| 6,395,442 | B1 | | 5/2002 | Hayashi et al. | |
| 6,576,389 | B2 | | 6/2003 | Vanbesien et al. | |
| 6,617,092 | B1 | | 9/2003 | Patel et al. | |
| 6,627,373 | B1 | | 9/2003 | Patel et al. | |
| 6,638,677 | B2 | | 10/2003 | Patel et al. | |
| 6,656,657 | B2 | | 12/2003 | Patel et al. | |
| 6,656,658 | B2 | | 12/2003 | Patel et al. | |
| 6,664,017 | B1 | | 12/2003 | Patel et al. | |
| 6,673,505 | B2 | | 1/2004 | Jiang et al. | |
| 6,730,450 | B1 | | 5/2004 | Moffat et al. | |
| 6,743,559 | B2 | | 6/2004 | Combes et al. | |
| 6,756,176 | B2 | | 6/2004 | Stegamat et al. | |
| 6,780,500 | B2 | | 8/2004 | Dumouchel et al. | |
| 6,830,860 | B2 | | 12/2004 | Sacripante et al. | |
| 7,029,817 | B2 | | 4/2006 | Robinson et al. | |
| 2008/0050667 | A1 | * | 2/2008 | Lobo et al. | 430/108.1 |

OTHER PUBLICATIONS

U.S. Appl. No. 11/549,249, filed Oct. 13, 2006.

* cited by examiner

*Primary Examiner*—Tae H Yoon
(74) *Attorney, Agent, or Firm*—Oliff & Berridge, PLC

(57) ABSTRACT

A polyester resin emulsion includes crosslinked polyester resin in an emulsion medium, the crosslinked polyester resin having a degree of crosslinking of from about 0.1 percent to about 100 percent. The emulsion can be formed by solvent flashing a mixture of a polyester resin, an initiator, a solvent, and an emulsion medium, wherein the crosslinked polyester resin has a degree of crosslinking of from about 0.1 percent to about 100 percent.

4 Claims, No Drawings

POLYESTER EMULSION CONTAINING CROSSLINKED POLYESTER RESIN, PROCESS, AND TONER

TECHNICAL FIELD

This disclosure is generally directed to polyester resin emulsions containing crosslinked polyester resins, as well as to methods of preparing such emulsions, and toner compositions made using such emulsions. More specifically, this disclosure is directed to an in situ crosslinking process to produce polyester resin emulsions containing crosslinked polyester resins. Such polyester resin emulsions can be used, for example, in the preparation of toner compositions.

RELATED APPLICATIONS

Commonly assigned, U.S. patent application Ser. No. 11/549,249 filed Oct. 13, 2006, describes a process for preparing a toner, comprising: solvent flashing wax and resin together to emulsify the resin and wax to a sub-micron size; mixing the wax and resin emulsion with a colorant, and optionally a coagulant to form a mixture; heating the mixture at a temperature below a glass transition temperature of said resin to aggregate said resin, colorant, and wax, to form aggregated particles; heating the aggregated particles and coalescent agent at a temperature above the glass transition temperature of said resin, to coalesce said aggregated particles to form toner particles, optionally cooling the mixture; and isolating the toner particles.

The appropriate components and process aspects of the foregoing may be selected for the present disclosure in embodiments thereof, and the entire disclosure of the above-mentioned application is totally incorporated herein by reference.

BACKGROUND

Illustrated herein in embodiments are crosslinking processes, and more specifically, in situ crosslinking processes, for making polyester resin emulsions containing crosslinked polyester resins. More specifically, in embodiments is provided a process to produce crosslinked polyester emulsions wherein an unsaturated polyester resin is crosslinked in situ in a solvent flashing emulsification process utilizing free radical initiators. Tile emulsions can be used, for example, to produce toner compositions that exhibit excellent fusing performance, excellent relative humidity sensitivity and high temperature/high humidity charging performance, while still providing desirable gloss properties.

To achieve desired ultra low melt performance in various toner formulation applications, it is advantageous to utilize a blend of crystalline and amorphous polyester resins in the toner formulations. Crystalline resins alone in toners provide excellent low melt and high gloss performance, but tend to provide poor fusing latitude. Amorphous resins alone in toners provide excellent release performance, but their low melt performance is limited by blocking and document offset requirements. By mixing both crystalline and amorphous resins, it may be possible to achieve both ultra low minimum fix temperature and wide fusing latitude.

In one approach, amorphous resins comprised of linear or branched saturated polyester resins have been used in toner formulations that resulted in excellent gloss and fusing performance when used in combination with unsaturated crystalline polyester resins. However, this tends to result in poor relative humidity (RH) sensitivity and high temperature/high humidity (80° F./80-85 percent RH) charging performance.

In another approach, polyester based toners comprised of linear unsaturated resins such as for example propoxylated bisphenol A fumarate resin and unsaturated crystalline resin have been provided. These toners show excellent fusing performance as well as excellent RH sensitivity and high temperature/high humidity charging performance. However, the gloss is very high as compared with conventional toners, and document offset is poor. It is known that increasing resin glass transition temperature (Tg) can reduce gloss and improve document offset. This, however, results in larger resin emulsion sizes during resin emulsification, making it more difficult to produce the toners. In the case of styrene-acrylate emulsion aggregation toner processes, resin emulsions comprised of crosslinked resin particles such as, for example, generated from the emulsion polymerization of styrene, butyl acrylate, divinylbenzene and beta carboxy ethyl acrylate are utilized to reduce gloss. There has been, however, no known method to produce similar emulsions containing crosslinked polyester resins.

A known process for emulsifying polyester resins is by solvent flashing wherein the resin is dissolved in an organic solvent such as for example ethyl acetate at an elevated temperature but below the boiling point of said solvent such as for example 65° C. The resulting solution is mixed into water containing an anionic surfactant such as Taycapower BN2060 (Tayca Corp., Japan), mixed with a homogenizer and then heated to a further elevated temperature above the boiling point of said solvent such as for example 80° C. to flash off the solvent and then cooled to room temperature.

Further known solvent flashing emulsification processes for polyester resins utilize bases such as, for example, sodium hydroxide or ammonium hydroxide, as the stabilizer with reduced or substantially no surfactant. Such processes have the added advantage of reducing the need to remove the surfactants in toner washing processes such as to enable satisfactory toner charging and development performance.

Unfortunately, if one was to attempt emulsification of crosslinked polyester resins by the known solvent flashing methods, major difficulties would be encountered because the crosslinked polyester is substantially not soluble in most common solvents.

The processes of the disclosure, in embodiments, provide a means for the preparation of toner compositions containing crosslinked polyester resins wherein the crosslinking is carried out in situ in the solvent flashing process during resin emulsification, and thereby circumventing the difficulties encountered in emulsifying polyester resins which have already been crosslinked.

REFERENCES

In U.S. Pat. No. 6,395,442, there is illustrated a toner for electrophotography. The resin binder is obtained by fusing fine resin particles comprising a crystalline material and amorphous polymer in a water-based medium. The crystalline material preferably has a melting point of 60 to 130° C., a number average molecular weight of 1,500 to 15,000, and a melt viscosity at the melting point +20° C. of not more than 100 Pa·s, and the amorphous polymer is preferably composed of a radically polymerizable monomer.

Illustrated in U.S. Pat. No. 5,994,020, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof, (iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

Emulsion aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817.

The disclosures of each of the foregoing patents and publications are hereby incorporated by reference herein in their entireties. The appropriate components and process aspects of the each of the foregoing patents and publications may also be selected for the present compositions and processes in embodiments thereof.

SUMMARY

The processes of the disclosure, in embodiments, provide polyester resin emulsions containing crosslinked polyester resins. The disclosed methods produce crosslinked polyester emulsions, which can be used for toner formation, wherein an unsaturated polyester resin is crosslinked in situ in a solvent flashing emulsification process. In embodiments, the process utilizes free radical initiators, such as for example, organic peroxides and azo compounds. A toner containing the in situ crosslinked polyester particles exhibits improved gloss performance as compared with comparable toners not including the crosslinked polyester resins, but containing only non-crosslinked resin. In the preparation process, no additional process steps are added that would otherwise increase the cost of producing resin emulsions.

In particular, in embodiments, there is provided a polyester resin emulsion comprising crosslinked polyester resin in an emulsion medium, the crosslinked polyester resin having a degree of crosslinking of from about 0.1 percent to about 100 percent. The emulsion can be formed, for example, by solvent flashing a mixture of a polyester resin, an initiator, a solvent, and an emulsion medium, wherein the crosslinked polyester resin has a degree of crosslinking of from about 0.1 percent to about 100 percent.

In another embodiment there is provided a toner composition, comprising:

a polymer resin comprising at least a crosslinked polyester resin, the crosslinked polyester resin having a degree of crosslinking of from about 0.1 percent to about 100 percent;

optionally a wax;

a colorant;

optionally a coagulant; and optionally one or more surface additives on a surface of particles of said toner composition.

EMBODIMENTS

The toner of the present disclosure is comprised of toner particles comprised of at least one or more polyester resins including one or more crosslinked polyester resins, an optional wax, a colorant, and an optional coagulant. The toner particles may also include other conventional optional additives, such as colloidal silica (as a flow agent) and the like. Beneficially, the toner of embodiments is made by a process that includes in situ formation of the crosslinked polyester resin emulsion, such as by a solvent flashing process. Optionally, the wax component can be incorporated into the emulsion at the same time. A benefit of the in situ formation process with solvent flashing is that it provides an emulsion containing crosslinked polyester resin, which can subsequently be incorporated in the toner particles. Further, when wax is included in the emulsion, it avoids the necessity of emuslifying the wax as an extra step.

The specific polymer resin or resins selected for the present disclosure include, for example, polyester and/or its derivatives, including polyester resins and branched polyester resins, in situ formed crosslinked polyester resins, polyimide resins, branched polyimide resins, poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and crystalline polyester resins.

Illustrative examples of polymer resins selected for the process and particles of the present disclosure include any of the various polyesters, such as crystalline polyesters, linear and/or branched amorphous polyesters, crosslinked polyesters formed in situ from said linear and/or branched amorphous polyesters, or a mixture thereof. Crystalline polyesters include saturated or unsaturated polyesters, or mixtures thereof. Linear and or branched amorphous polyesters include unsaturated polyesters, and optionally saturated polyesters. Thus, for example, the toner particles can be comprised of crystalline polyester resins, amorphous polyester resins, or a mixture of two or more polyester resins where one or more polyester is crystalline and one or more polyester is amorphous.

Illustrative examples of crystalline polymer resins selected for the process and particles of the present disclosure include any of the various crystalline polyesters, such as poly(ethylene-adipate), poly(propylene-adipate, poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl) -copoly(propylene-adipate),copoly(5-sulfoisophthaloyl)-copoly(butylene-adipate), copoly(5-sulfo-isophthaloyl)-copoly(pentylene-adipate), copoly(5-sulfo-isophthaloyl) -copoly(hexylene-adipate),copoly(5-sulfo-isophthaloyl)-copoly(octylene-adipate), copoly(5-sulfo-isophthaloyl)-copoly(ethylene-adipate), copoly(5-sulfo-isophthaloyl) -copoly(propylene-adipate),copoly(5-sulfo-isophthaloyl)-copoly(butylene-adipate), copoly(5-sulfo-isophthaloyl)-copoly(pentylene-adipate), copoly(5-sulfo-isophthaloyl) -copoly(hexylene-adipate),copoly(5-sulfo-isophthaloyl)-copoly(octylene-adipate), copoly(5-sulfoisophthaloyl)-copoly(ethylene-succinate), copoly(5-sulfoisophthaloyl) -copoly(propylene-succinate),copoly(5-sulfoisophthaloyl)-copoly(butylene-succinate), copoly(5-sulfoisophthaloyl)-copoly(pentylene-succinate), copoly(5-sulfoisophthaloyl) -copoly(hexylene-succinate),copoly(5-sulfoisophthaloyl)-copoly(octylene-succinate), copoly(5-sulfo-isophthaloyl)-copoly(ethylene-sebacate), copoly(5-sulfo-isophthaloyl) -copoly(propylene-sebacate),copoly(5-sulfo-isophthaloyl)-copoly(butylenes-sebacate), copoly(5-sulfo-isophthaloyl)-copoly(pentylene-sebacate), copoly(5-sulfo-isophthaloyl) -copoly(hexylene-sebacate),copoly(5-sulfo-isophthaloyl)-copoly(octylene-sebacate), copoly(5-sulfo-isophthaloyl)-copoly(ethylene-adipate), copoly(5-sulfo-isophthaloyl) -copoly(propylene-adipate),copoly(5-sulfo-isophthaloyl)-copoly(butylene-adipate), copoly(5-sulfo-isophthaloyl)-copoly(pentylene-adipate), copoly(5-sulfo-isophthaloyl) -copoly(hexylene-adipate), or poly(octylene-adipate).

The crystalline resins, which are available from a number of sources, can possess various melting points of, for example, from about 30° C. to about 120° C., such as from about 50° C. to about 90° C. The crystalline resin may have, for example, a number average molecular weight (Mn), as measured by gel permeation chromatography (GPC) of, for example, from about 1,000 to about 50,000, and preferably from about 2,000 to about 25,000. The weight average molecular weight (Mw) of the resin may be, for example, from about 2,000 to about 100,000, and preferably from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resins can be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof, and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphtlyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Illustrative examples of saturated and unsaturated amorphous polymer resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(propoxylated bisphenol-fumarate), poly(propoxylated bisphenol-succinate), poly(propoxylated bisphenol-adipate), poly(propoxylated bisphenol-glutarate), SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyananinde), ARMCO™ (Armaco Composites), ARPOL™ (Ashland Chemical), CELANEX™ (Celanese Eng), RYNITE™ (DuPont), STYPOL™ (Freeman Chemical Corporation) mixtures thereof and the like. The resins can also be functionalized, such as carboxylated, sulfonated, or the like, and particularly such as sodio sulfonated, if desired.

The amorphous resins, linear or branched, which are available from a number of sources, can possess various onset Tg's of, for example, from about 40° C. to about 80° C., such as from about 50° C. to about 70° C. as measured by differential scanning calorimetry, (DSC). The linear and branched amorphous polyester resins, in embodiments, possess, for example, a number average molecular weight (Mn), as measured by GPC, of from about 10,000 to about 500,000, such as from about 5,000 to about 250,000; a weight average molecular weight (Mw) of, for example, from about 20,000 to about 600,000, such as from about 7,000 to about 300,000, as determined by GPC using polystyrene standards; and a molecular weight distribution (Mw/Mn) of, for example, from about 1.5 to about 6, such as from about 2 to about 4.

The linear amorphous polyester resins are generally prepared by the polycondensation of an organic diol, a diacid or diester, and a polycondensation catalyst. For the branched amorphous sulfonated polyester resin, the same materials may be used, with the further inclusion of a branching agent such as a multivalent polyacid or polyol. The amorphous resin is generally present in the toner composition in various suitable amounts, such as from about 60 to about 90 weight percent, or from about 50 to about 65 weight percent, of the toner or of the solids.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthatate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and mixtures thereof. The amount of organic diol selected can vary, and more specifically, is, for example, from about 45 to about 52 mole percent of the resin.

Branching agents for use in forming the branched amorphous sulfonated polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Examples of suitable polycondensation catalyst for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof, and which catalysts are selected in amounts of, for example, from about 0.01 mole percent to about 5 mole percent based on the starting diacid or diester used to generate the polyester resin.

Linear or branched unsaturated polyesters selected for the in situ preparation of the crosslinked polyester particles and process of the present disclosure include low molecular weight condensation polymers which may be formed by the step-wise reactions between both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins useful for the present invention are prepared by melt polycondensation or other polymerization processes using diacids and/or anhydrides and diols. Suitable diacids and dianhydrides include but are not limited to saturated diacids and/or dianhydrides such as for example succinic acid, glutaric acid, adipic acid, pimelic acid, suberic acid, azelaic acid, sebacic acid, isophthalic acid, terephthalic acid, hexachloroendo methylene tetrahydrophthlalic acid, phthalic anhydride, chlorendic anhydride, tetrahydrophthalic anhydride, hixahydrophthalic anhydride, endomethylene tetrahydrophthalic anhydride, tetrachlorophthalic anhydride, tetrabromophthalic anhydride, and the like and mixtures thereof, and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof Suitable diols include but are not limited to for example propylene glycol, ethylene glycol, diethylene glycol, neopentyl glycol, dipropylene glycol, dibromoneopentyl glycol propoxylated bisphenol A, 2,2,4-trimethylpentane-1,3-diol, tetrabromo bisphenol dipropoxy ether, 1,4-butanediol, and the like and mixtures thereof. Preferred unsaturated polyester resins are prepared from diacids anchor anhydrides such as, for example, maleic anhydride, fumaric acid, and the like and mixtures thereof, and diols such as for example, propoxylated bisphenol A, propylene glycol, and the like and mixtures thereof.

The monomers used in making the selected polymer are not limited, and the monomers utilized may include any one or more of, for example, ethylene, propylene, and the like. Known chain transfer agents, for example dodecanethiol or carbon tetrabromide, can be utilized to control the molecular weight properties of the polymer. Any suitable method for forming the polymer from the monomers may be used without restriction.

The polymer resin may be present in an amount of from about 65 to about 95 percent by weight, such as about 75 to about 85 percent by weight, of the toner particles (that is, toner particles exclusive of external additives) on a solids basis. The ratio of crystalline resin to amorphous resin can be in the range from about 1:99 to about 30:70, such as from about 5:95 to about 25:75. However, amounts and ratios outside of these ranges can be used, in embodiments, depending upon the type and amounts of other materials present.

Conventionally, such as for emulsion aggregation toner processes, the linear or branched resin latex or emulsion can be prepared by any suitable means. For example, the latex or emulsion can conventionally be prepared by taking the resin and heating it to its melting temperature and dispersing the resin in an aqueous phase containing a surfactant. The dispersion can be carried out by various dispersing equipment such as an ultimizer, high speed homogenizer, or the like to provide submicron resin particles (particles having an average diameter or particle size of less than about 1 micron). Other conventional ways to prepare the resin latex or emulsion include solvent flashing wherein, for example, the resin is dissolved in a solvent and adding it to heated water to flash evaporate the solvent. External dispersions have also been employed to assist the formation of emulsion as the solvent is being evaporated.

In embodiments, linear or branched polyester resins are solvent flashed, wherein the resin is dissolved in an organic solvent such as for example ethyl acetate at an elevated temperature but below the boiling point of the solvent such as for example about 65° C. The resulting solution is mixed into water containing an anionic surfactant such as Taycapower BN2060 (Tayca Corp., Japan), mixed with a homogenizer and then heated to a further elevated temperature above the boiling point of the solvent such as for example about 80° C. to flash off the solvent and then cooled to room temperature. In other embodiments, the emulsification processes utilizes bases such as for example sodium hydroxide or ammonium hydroxide as the stabilizer with reduced or substantially no surfactant. Such processes have the added advantage of reducing the need to remove the surfactants in toner washing processes such as to enable satisfactory toner charging and development performance.

If one was to attempt emulsification of polyester resins containing crosslinked resins by the processes described in the above embodiments, major difficulties would be encountered because the crosslinked polyester resin is substantially not soluble in most common solvents. To avoid this difficulty, according to embodiments, crosslinking is carried out in situ in the emulsification process, that is, crosslinking of the polyester resin is performed while the emulsification of the resin is being carried out by for example solvent flashing.

A particularly suitable in situ crosslinking process utilizes an unsaturated resin such as for example an unsaturated amorphous linear or branched polyester resin.

According to embodiments, therefore, the resin dispersion is made by solvent flashing the resin component to crosslink and emulsify the resin to a sub-micron size. The resin emulsion can then be used in a variety of applications to form a variety or products, such as toner particles. For toner preparation, the resin emulsion can be mixed with a colorant, optionally a wax, and optionally a coagulant to form a mixture for further processing according to known processes.

Although any of the above mentioned resins can be used in forming the crosslinked resin emulsion, in embodiments it is desired that the emulsion not be formed with a mixture of crystalline resin and amorphous resin. That is, the emulsion in embodiments is formed using an amorphous resin, a mixture of amorphous resins, a crystalline resin, or a mixture of crystalline resins, but not a mixture of amorphous resin and crystalline resin, If amorphous resin and crystalline resin are mixed together to form the resin and wax emulsion, the crystalline resin will tend to plastify the amorphous resin, resulting in a substantial drop in the Tg.

To form the crosslinked resin emulsion, the unsaturated polyester resin and an initiator are dissolved in a suitable organic solvent under conditions that allow the solution to be formed. Suitable solvents that can be used include those in which the resin and any other optional components (such as a wax) is soluble, and that dissolves the resin component to form an emulsion, but which solvents can be subsequently flashed off to leave the resin in an emulsion, such as in water, at the desired particle size. For example, suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. Particular solvents that can be used include acetone, methyl ethyl ketone, cyclohexanone, methyl acetate, ethyl acetate, dimethylsulfoxide, and mixtures thereof. If desired or necessary, the resin can be dissolved in the solvent at elevated temperature, such as about 40 to about 80° C. or about 50 to about 70° or about 60 to about 65° C., although the temperature is desirable lower than the glass transition temperature of the resin. In embodiments, the resin is dissolved in the solvent at elevated temperature, but below the boiling point of the solvent, such as at about 2 to about 15° C. or about 5 to about 10° C. below the boiling point of the solvent.

In addition to the resin and organic solvent, an initiator is included that subsequently crosslinks the resin. Any suitable initiator can be used, such as for example free radical or thermal initiators such as organic peroxides and azo compounds. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy)hexane, t-butyl cumyl peroxide, α-α-bis(t-butyl peroxy) diisopropyl benzene, di-t-butyl peroxide and 2,5-dimethyl 2,5-di (t-butyl peroxy)hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di(t-amyl peroxy)cyclohexane, 2,2di(t-butyl peroxy)butane, ethyl 3,3-di(t-butyl peroxy)butyrate and ethyl 3,3-di(t-amyl peroxy)butyrate. Examples of suitable azo compounds include 2,2,'-azobis(2,4-dimethylpentane nitrile, azobis-isobutyronitrile, 2,2'-azobis (isobutyronitrile), 2,2'-azobis (2,4-dimethyl valeronitrile), 2,2'-azobis(methyl butyronitrile), 1,1'-azobis(cyano cyclohexane) and other similar known compounds.

Although any suitable initiator can be used, in embodiments the initiator is an organic initiator that is soluble in the solvent, but not soluble in water. Further, the initiator should be substantially unreactive at temperatures up to about 65 to about 70° C. such that substantially no crosslinking takes place until after the resin-solvent phase is well dispersed in the water phase. As used herein, "substantially no crosslinking" refers for example to less than about 1 percent, such as less than about 0.5 percent, or less than about 0.1 percent, cross linking between polymer chains in the resin. Still further, it is desired that substantially all of the initiator should react during the solvent flashing step when the mixture is raised to above about the boiling point of the solvent, such as about 80° C. or more, to flash off the residual solvent. Thus, for example, the choice of initiator can be directed by its half-life/temperature characteristic. For example, half-life/temperature characteristic plots for Vazo® 52 (2,2,'-azobis(2,4-dimethylpentane nitrile, E. I. du Pont de Nemours and Company, USA) shows a half-life greater than 90 minutes at 65° C. and less than 20 minutes at 80° C., which indicates that the initiator is particularly suitable for carrying out the crosslinking in the present solvent flashing process, because substantially no crosslinking takes place during the initial mixing phase of resin and solvent at 65° C. and substantially all of the crosslinking occurs during the solvent flashing step at temperatures up to 80° C.

The initiator can be included in any suitable amount to provide the desired degree of crosslinking. In embodiments, the initiator can be included in an amount of, for example, from about 0.1 to about 20 percent by weight of unsaturated resin, such as from about 0.5 or from about 1 to about 10 or about 15 percent by weight of unsaturated resin. In an embodiment, about 3 to about 6 percent by weight initiator is added.

After the resin and initiator are dissolved in the solvent, the resin and initiator solution is mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present at a level of from about 0.1 to about 5 percent, such as about 0.5 to about 3 percent by weight of the resin. When such salts are added to the composition as a stabilizer, it is desired in embodiments that incompatible metal salts are not present in the composition. For example, when these salts are used the composition should be completely or essentially free of zinc and other incompatible metal ions, e.g., Ca, Fe, Ba, etc. which form water-insoluble salts. The term "essentially free" refers, for example, to the incompatible metal ions as present at a level of less than about 0.01 percent, such as less than about 0.005 or less than about 0.001 percent by weight of the wax and resin. If desired or necessary, the stabilizer can be added to the mixture at ambient temperature, or it can be heated to the mixture temperature prior to addition.

Optionally, it may be desirable to add an additional stabilizer such as a surfactant to the aqueous emulsion medium such as to afford additional stabilization to the resin particles, particularly if wax is also included in the emulsion, albeit at a reduced level as compared to conventional wax emulsions. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co. Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture can be mixed or homogenized for any desired time.

Next, the mixture is heated to flash off the solvent, and then cooled to room temperature. For example, the solvent flashing can be conducted at any suitable temperature at or above about the boiling point of the solvent in water that will flash off the solvent, such as about 60 to about 100° C., for example about 70 to about 90° C. or about 80° C., although the temperature may be adjusted based on, for example, the particular resin and solvent used.

Following the solvent flash step, the crosslinked polyester resin particles in embodiments have an average particle diameter in the range of about 100 to about 500 nanometers, such as from about 130 to about 300 nanometers as measured with a Honeywell MICROTRAC® UPA150 particle size analyzer.

In summary, the emulsion formation process can be stated as follows:

(i) Measure resin into a suitable container;

(ii) Add a desired amount of initiator to resin;

(iii) Add solvent to resin;

(iv) Dissolve resin in solvent by heating (for example below the solvent boiling point) and with stirring;

(v) Add a desired amount of stabilizer to a reactor vessel, where the amount of stabilizer generally depends upon the acid number of the resin;

(vi) Add emulsion medium, such as deionized water, to the stabilizer;

(vii) Optionally heat the stabilizer/emulsion medium solution to an elevated temperature, but below the boiling point of the solvent, such as about 65° C.;

(viii) Begin homogenizing the stabilizer/emulsion medium solution;

(ix) Slowly pour the resin solution into the stabilizer/emulsion medium solution as the mixture continues to be homogenized, and optionally increase homogenizer speed;

(x) Homogenize the mixture;

(xi) Place the homogenized mixture into a suitable vessel for solvent flashing, such as a heat jacketed distillation apparatus;

(xii) Commence stirring and heat the homogenized mixture to above about the boiling point of the solvent;

(xiii) Distill or solvent flash the solvent from the homogenized mixture, and then cool the mixture;

(xiv) Optionally discharge the product from the solvent flash apparatus, screen the product as necessary; and (xv) pH adjust the product to 7.0 as necessary.

The crosslinked polyester resin in embodiments is generally present in the resin emulsions in an amount of from about 5 to about 50 percent by weight, such as from about 10 to about 40 percent by weight. However, amounts outside these ranges can be used. Further, the degree of crosslinking in the crosslinked polyester resin can range from about 0.1 percent to about 100 percent, such as from about 0.5 percent to about 75 percent, or from about 1 percent to about 50 percent, where the degree of crosslinking is defined as the fraction of polymer chains in a particle that have crosslinked. Crosslinked resins with a degree of crosslinking less than about 50 percent are commonly called partially crosslinked resins.

The thus-produced polyester resin emulsions containing crosslinked or partially crosslinked polyester resins can be used for a variety of purposes, including for producing a toner for electrostatographic imaging processes, for powder coatings in metal finishes such as for appliances, and the like.

Furthermore, when used in these and other applications, the polyester resin emulsions containing crosslinked polyester resins provide significant benefits and property improvements. For example, a benefit of the process of the present disclosure is that the performance of toner compositions containing crosslinked polyester particles from the in situ crosslinking process show lower gloss performance as compared with toners containing non-crosslinked polyester alone. Meanwhile, despite these improvements, other toner properties such as fusing and charging properties, remain unchanged.

There are also several modes to utilize the polyester resin emulsions containing crosslinked polyester resins in toner preparation. One approach is to produce a highly crosslinked polyester emulsion wherein only a small amount of the emulsion is mixed with uncrosslinked emulsion containing polyester in the toner procedure. Alternatively, a polyester emulsion containing a lower degree of crosslinking wherein no additional uncrosslinked or only a small amount of uncrosslinked emulsion is needed in the toner procedure can be provided.

In embodiments, the resin emulsion can be prepared to also include wax therein. In these embodiments, the emulsion will include resin and wax particles at the desired loading levels, which allows for a single resin and wax emulsion to be made rather than separate resin and wax emulsions. Further, in these embodiments, the combined emulsion allows for reduction in the amount of surfactant needed to prepare separate emulsions for incorporation into toner compositions. This is particularly helpful in instances where it would otherwise be difficult to incorporate the wax into the emulsion. However, in embodiments, the wax can also be separately emulsified, such as with a resin, and separately incorporated into final products.

In addition to the polymer binder resin, the toners of the present disclosure also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes and functionalized waxes. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, and polypropylene wax, and mixtures thereof.

Examples of waxes of embodiments include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 1,000 to about 1,500, while the commercially available polypropylenes utilized have a molecular weight of about 4,000 to about 5,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and Johnson Diversey, Inc. Many of the polyethylene and polypropylene compositions useful in embodiments are illustrated in British Pat. No. 1,442,835, the entire disclosure of which is incorporated herein by reference.

The toners may contain the wax in any amount of from, for example, about 3 to about 15 percent by weight of the toner, on a dry basis. For example, the toners can contain from about 5 to about 11 percent by weight of the wax.

The toners also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1 percent to about 25 percent by weight based upon the total weight of the composition. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Geib 1250 (BASF), Suco-Yellow D1355 (BASF), Suco Fast Yellow D1165, D1355 and D1351 (BASF), Hostaperm Pink F (Hoechst), Fanal Pink D4830 (BASF), Cinquasia Nagenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites, Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof Illustrative examples of cyans include copper tetra (octadecyl sulfonamide) phthalocyanine, x-copper phthalocyanine pigment listed in the Color Index as CI74160, CI Pigment Blue, and Anthtathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 percent by weight of the toner particles on a solids basis, such as from about 5 to about 25 percent by weight or from about 5 to about 15 percent by weight. However, amounts outside these ranges can also be used, in embodiments.

The toners of the present disclosure may also contain a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from 0 to about 5 percent by weight of the toner particles, such as from about greater than 0 to about 3 percent by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Any suitable emulsion aggregation procedure may be used in forming the emulsion aggregation toner particles without restrictions These procedures typically include the basic process steps of at least aggregating an emulsion containing polymer binder and one or more waxes, one or more colorants, one or more surfactants, an optional coagulant, and one or more additional optional additives to form aggregates, subsequently coalescing or fusing the aggregates, and then recovering, optionally washing and optionally drying the obtained emulsion aggregation toner particles. However, in embodiments, the process utilizes a combined wax and resin emulsion, which is produced by a solvent flash process, rather than separate resin and wax emulsions.

Suitable emulsion aggregation/coalescing processes for the preparation of toners, and which can be modified to include the solvent flash emulsion preparation as described herein, are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693. 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. Patents may be selected for the present composition and process in embodiments thereof.

In embodiments hereof, the toner process comprises forming a resin emulsion by solvent flashing as described above, optionally including a wax component, mixing the resin emulsion with deionized water, to which is added a colorant dispersion and/or a wax dispersion and an optional coagulant while blending at high speeds such as with a polytron. The resulting mixture is further aggregated by adding aqueous solution of acid until the pH of the mixture is from about 4.0 to about 5.5, and heating to a temperature of from about 30° C. to 60° C., wherein the aggregate grows to a size of from about 3 to about 20 microns. The pH of the mixture is then changed, for example by the addition of a sodium hydroxide solution until a pH of about 7 to 9 and the mixture is heated to above the resin Tg, such as to about 75° C. to about 95° C., and the pH is optionally decreased to a range of 6.0 to 6.8. The coalesced particles can be measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

The toner particles of the present disclosure can be made to have the following physical properties when no external additives are present on the toner particles.

The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution, Shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular basis. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.980.

It is desirable in embodiments that the toner particle has separate crystalline polyester and wax melting points and amorphous polyester glass transition temperature as measured by DSC, and that the melting temperatures and glass transition temperature are not substantially depressed by plastification of the amorphous or crystalline polyesters by the wax.

The toner particles can be blended with external additives following formation. Any suitable surface additives may be used in embodiments. Most suitable are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is optionally also used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. In embodiments, a commercially available zinc stearate known as Zinc Stearate L, obtained from Ferro Corporation, can be used. The external surface additives can be used with or without a coating.

In embodiments, the toners contain from, for example, about 0.1 to about 5 weight percent titania, about 0.1 to about 8 weight percent silica and about 0.1 to about 4 weight percent zinc stearate.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of modular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyoletins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Six examples and one comparative example are provided below. Examples I and II describe a process for producing surfactantless emulsions containing crosslinked amorphous polyester resin stabilized with sodium bicarbonate. Example III describes a process for producing a surfactantless emulsion containing noncrosslinked amorphous polyester resin stabilized with sodium bicarbonate. Example IV describes a process for producing a surfactantless emulsion containing crystalline polyester resin stabilized with sodium bicarbonate. Example V describes an emulsion aggregation process for producing an ultra low melt toner wherein the emulsions of Examples I and IV are utilized as ingredients. Example VI describes an emulsion aggregation process for producing an ultra low melt toner wherein the emulsions of Examples II, III and IV are utilized as ingredients. Comparative Example VII describes an emulsion aggregation process for producing an ultra low melt toner wherein the emulsions of Examples III and IV are utilized as ingredients.

Example I

Preparation of Crosslinked Amorphous Polyester Emulsion with 3% by Weight VAZO®52 Initiator 125 grams of amorphous propoxylated bisphenol A fumarate resin having an acid number of about 16.7 as measured by titration with KOH, weight average and number average molecular weight of 12,000 and 4,200 respectively as measured by DSC and onset glass transition temperature of about 56° C. as measured by DSC, and 3.87 grams of VAZO® 52 free radical thermal initiator (E.I. du Pont de Nemours and Company, USA) are measured into a 2 liter beaker containing about 917 grams of ethyl acetate. The mixture is stirred at about 250 revolutions per minute and heated to about 67° C. to dissolve the resin and initiator in the ethyl acetate. 3.05 grams of sodium bicarbonate are measured into a 4 liter Pyrex glass flask reactor containing about 708 grams of deionized water and heated to about 65° C. Homogenization of the heated water solution in the 4 liter glass flask reactor is commenced with an IKA Ultra Turrax T50 homogenizer at 4,000 revolutions per minute. The heated resin and wax solution is then slowly poured into the water solution as the mixture continues to be homogenized, the homogenizer speed is increased to 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of the mixture is increased to 80° C. at about 1° C. per minute to distill off the ethyl acetate from the mixture. Stirring of the mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. The resulting crosslinked resin emulsion is comprised of about 20.65% by weight solids in water as measured gravimetrically, and has a volume average diameter of about 143 nanometers as measured with a HONEYWELL MICROTRAC® UPA150 particle size analyzer. The onset glass transition temperature is about 59.3° C. as measured by DSC, the melt viscosity is about 68,000 Pascal-seconds at 80° C. and 635 Pascal-seconds at 130° C. as measured at 6.3 radians per second.

Example II

Preparation of Crosslinked Amorphous Polyester Emulsion with 6% by Weight VAZO® 52 Initiator Example II was prepared in the same way as Example I, except that the amount of VAZO® 52 is modified to 7.74 grams. The resulting resin emulsion is comprised of about 19.5 per cent by weight solids in water as measured gravimetrically, has a volume average diameter of about 152 nanometers as measured with a HONEYWELL MICROTRAC® UPA150 particle size analyzer, and has an onset glass transition temperature of about 55.4° C. as measured by DSC, the melt viscosity is about 53,000 Pascal-seconds at 80° C. and 5,900 Pascal-seconds at 130° C. as measured at 6.3 radians per second.

Example III

Preparation of Uncrosslinked Amorphous Polyester Emulsion

Example I is repeated, except that the 3.87 grams of VAZO® 52 free radical thermal initiator is omitted. The resulting resin emulsion is comprised of about 26.47% by weight solids in water as measured gravimetrically, and has a volume average diameter of about 143 nanometers as measured with a HONEYWELL MICROTRAC® UPA150 particle size analyzer. The onset glass transition temperature is about 56.4° C. as measured by DSC, the melt viscosity is about 68,000 Pascal-seconds at 80° C. and 100 Pascal-seconds at 130° C. as measured at 6.3 radians per second.

Example IV

Preparation of Crystalline Polyester Emulsion 125 grams of semi-crystalline CPES-A11 polyester resin (Kao Corporation, Japan) having an acid number of about 13.2 as measured by titration with KOH, weight average and number average molecular weight of 13,600 and 6,700 respectively as measured by DSC and melting point of about 86° C. as measured by DSC, is measured into a 2 liter beaker containing about 917 grams of ethyl acetate. The mixture is stirred at about 250 revolutions per minute and heated to about 65° C. to dissolve the resin in the ethyl acetate. 2.4 grams of sodium bicarbonate are measured into a 4 liter Pyrex glass flask reactor containing about 708 grams of deionized water and heated to about 65° C. Homogenization of the heated water solution in the 4 liter glass flask reactor is commenced with a IKA Ultra Turrax T50 homogenizer at 4,000 revolutions per minute. The heated resin solution is then slowly poured into the water solution as the mixture continues to be homogenized, the homogenizer speed is increased to 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of the mixture is increased to 80° C. at about 1° C. per minute to distill off the ethyl acetate from the mixture. Stirring of the mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. The resulting resin emulsion is comprised of about 21 9% by weight crystalline polyester resin in water as measured gravimetrically and has a volume average diameter of about 282 nanometers as measured with a HONEYWELL MICROTRAC® UPA150 particle size analyzer.

Example V

Preparation of Polyester Toner Containing 4.5% Cyan Pigment

A 2 liter kettle, equipped with a mechanical stirrer and heating mantle is charged with 471.7 grams of emulsion of Example I comprised of crosslinked propoxylated bisphenol A fumarate resin in water, 78.5 grams of emulsion of Example IV comprising of crystalline polyester resin in water, and 741 grams of water. The mixture is homogenized at 2,000 revolutions per minute, followed by the addition 34.6 grams of pigment dispersion comprising 17 per cent by weight of Pigment Blue 15:3 cyan pigment, followed by a drop wise addition of 90 grams of a 0.3 Normal solution of nitric acid. During the acid addition, the homogenization is increased to 4,500 revolutions per minute and maintained for about 5 minutes. The mixture is then stirred at 175 revolutions per minute, and heated to 36.5° C. followed by adding 4.5 gram solution of Taycapower BN2060 anionic surfactant (17.5 per cent solids by weight; Tayca Corporation, Japan), and the pH of the mixture is increased from 3.3 to about 6.82 with the addition of 4 per cent sodium hydroxide solution. The stirring is reduced to 70 revolutions per minute, and the mixture heated to 68° C. followed by decreasing the pH to about 6.0 by the addition of a 0.3 Normal solution of nitric acid. The toner of this mixture comprises about 81.2% by weight of amorphous polyester resin, about 14.3% by weight of crystalline polyester resin, and about 4.5% by weight of pigment, and has a volume average particle size of about 9.24 microns as measured with a Coulter Counter and a circularity of about 0.96 as measured with a SYSMEX® FPIA-2100 flowtype histogram analyzer. Fusing results show that the toner has a minimum fix temperature of about 139° C., a hot offset temperature greater than about 210° C., and a fusing latitude greater than about 71° C. as shown in Table 2. Further, an image prepared with the toner of this example has a 75 degree gloss of about 38 gloss units (ggu) as measured with a BYK Gardner microgloss meter.

Example VI

Preparation of Polyester Toner Containing 4.5% Cyan Pigment

Example V is repeated except that the 2 liter kettle is charged with 248.7 grams of emulsion of Example II comprised of crosslinked propoxylated bisphenol A fumarate resin in water. 182.4 grams of emulsion of Example III comprised of uncrosslinked propoxylated bisphenol A fumarate resin in water, 78.5 grams of emulsion of Example IV comprising of crystalline polyester resin in water, and 781 grams of water. The toner of this mixture comprises about 81.2% by weight of amorphous polyester resin, about 14.3% by weight of crystalline polyester resin, and about 4.5% by weight of pigment, and has a volume average particle size of about 8.0 microns as measured with a Coulter Counter and a circularity of about 0.965 as measured with a SYSMEX® FPIA-2100 flow-type histogram analyzer. Fusing results show that the toner has a minimum fix temperature of about 137° C., a hot offset temperature greater than about 210° C., and a fusing latitude greater than about 73° C. as shown in Table 2Further, an image prepared with the toner of this example has a 75 degree gloss of about 34 gloss units (ggu) as measured with a BYK Gardner micro-gloss meter.

Comparative Example VII

Preparation of Polyester Toner Containing 4.5% Cyan Pigment

Example V is repeated except that the 2 liter kettle is charged with 364.8 grams of emulsion of Example III comprised of non-crosslinked propoxylated bisphenol A fumarate resin in water, 78.5 grams of emulsion of Example VI comprising of crystalline polyester resin in water, and 848 grams of water The toner of this mixture comprises about 81.2% by weight of amorphous polyester resin, about 14.3% by weight of crystalline polyester resin, and about 4.5% by weight of pigment, and has a volume average particle size of about 8.0 microns as measured with a Coulter Counter and a circularity of about 0.96 as measured with a SYSMEX® FPLA-2100 flow-type histogram analyzer. Fusing results show that the toner has a minimum fix temperature of about 134° C., a hot offset temperature greater than about 210° C., and a fusing latitude greater than about 76° C. as shown in Table 2. Further, an image prepared with the toner of this example has a 75 degree gloss of about 66 gloss units (ggu) as measured with a BYK Gardner micro-gloss meter.

TABLE 1

| | Example I | Example II | Example III |
|---|---|---|---|
| Viscosity at 80° C. (Pa · s) | 68,000 | 53,000 | 68,000 |
| Viscosity at 130° C. (Pa · s) | 635 | 5,900 | 100 |

The viscosity data of dried resins of emulsions of Example I (3% VAZO® 52), Example II (6% VAZO® 52) and Example III (no initiator) as measured with a Rheometric Scientific SR-5000 rheometer are shown in Table 1. The viscosities of the resins are found to increase with higher amounts of initiator at higher temperatures, which is indicative of higher degrees of crosslinking in the resins. These resins are expected to have lower gloss as compared to resins made from emulsions having no initiator. At the same time, the viscosities of the resins at lower temperatures are very similar, suggesting that minimum fix temperature is not affected by the increasing degrees of crosslinking.

TABLE 2

| | Example V | Example VI | Comparative Example VII |
|---|---|---|---|
| Min. Fix Temp (° C.) | 139 | 137 | 134 |
| 75° Gloss (ggu) | 38 | 34 | 66 |

The fusing data of the toners of Example V (3% VAZO® 52 crosslinked resin), Example VI (mixture of 6% VAZO® 52 crosslinked resin and noncrosslinked resin) and Comparative Example VII (no crosslinked resin) are shown in Table 2. The minimum fix temperatures of the three toners are not substantially different, whereas the gloss values for the toners containing crosslinked resin are substantially lower than for the toner containing no crosslinked resin. Further, the gloss values of two toners containing crosslinked resin are substantially the same indicating that diluting a crosslinked resin having a higher degree of crosslinking has the same effect as utilizing a crosslinked resin with lower degree of crosslinking but without dilution.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of making a crosslinked polyester resin emulsion, comprising:

solvent flashing a mixture of a polyester resin, an initiator, a solvent, and an emulsion medium, the solvent flashing comprising:

mixing said polyester resin, said initiator, said solvent, said emulsion medium, and optionally a stabilizer to form a combined mixture; and heating the combined mixture at a temperature above a boiling point of said solvent but below a boiling point of said emulsion medium, wherein the crosslinked polyester resin has a degree of crosslinking of from about 0.1 percent to about 100 percent, the polyester resin is amorphous propoxylated bisphenol A fumarate resin, the solvent is ethyl acetate, and the initiator is 2,2'-Azobis(2,4-dimethyl)valeronitrile, which is substantially unreactive at temperatures up to and including 65° C. but is reactive at temperatures above 65° C., such that substantially no crosslinking takes place below 65° C. and substantially all of the crosslinking should take place during the heating step.

2. The method of claim 1, wherein 2,2'-Azobis(2,4-dimethyl)valeronitrile is present in an amount of from about 0.1 to about 20 percent by weight of unsaturated resin.

3. The method of claim 1, wherein the emulsion medium comprises water and optionally a stabilizer selected from the group consisting of water-soluble alkali metal hydroxides, ammonium hydroxide, alkali metal carbonates, and alkali metal bicarbonates.

4. A method of making a crosslinked polyester resin emulsion, comprising:

combining a polyester resin and an initiator;

adding a solvent to the polyester resin and initiator combination;

optionally heating the polyester resin and initiator combination to dissolve the resin in the solvent;

mixing a stabilizer and an emulsion medium, optionally with heating;

combining the polyester resin and initiator combination with the stabilizer and emulsion medium mixture to form a reaction mixture;

heating the reaction mixture to above about a boiling point of the solvent but below a boiling point of the emulsion medium to solvent flash the solvent from the reaction mixture;

optionally cooling and screening a resultant product emulsion; and optionally adjusting a pH of the resultant product emulsion to about neutral, wherein the crosslinked polyester resin has a degree of crosslinking of from about 0.1 percent to about 100 percent, the polyester resin is amorphous propoxylated bisphenol A fumarate resin, the solvent is ethyl acetate, and the initiator is 2,2'-Azobis(2,4-dimethyl)valeronitrile.

* * * * *